US005528813A

United States Patent [19]

Biafore, Jr.

[11] Patent Number: 5,528,813

[45] Date of Patent: Jun. 25, 1996

[54] METHOD OF ASSEMBLING A GOLF BAG

[75] Inventor: John J. Biafore, Jr., Shelby Township, Mich.

[73] Assignee: Focus Golf Systems, Inc., Clinton Township, Mich.

[21] Appl. No.: 411,901

[22] Filed: Mar. 28, 1995

Related U.S. Application Data

[62] Division of Ser. No. 275,517, Jul. 15, 1994, Pat. No. 5,445,267.

[51] Int. Cl.[6] ..... B21D 39/00

[52] U.S. Cl. ..... 29/452; 29/91.1; 206/315.8

[58] Field of Search ..... 29/436, 91, 91.1, 29/433, 446, 452, 457; 206/315.4, 315.8

[56] References Cited

U.S. PATENT DOCUMENTS

| | | | |
|---|---|---|---|
| 1,429,524 | 9/1922 | Myers | 206/315.8 |
| 2,599,635 | 6/1952 | Hotze | 206/315.8 |
| 2,698,040 | 12/1954 | Wilkens | 206/315.8 |
| 3,901,299 | 8/1975 | Picco | 206/315.4 |
| 4,448,305 | 5/1984 | Sup | 206/315.8 |
| 5,297,328 | 3/1994 | Reimers et al. | 29/91.1 X |
| 5,445,267 | 8/1995 | Biafore, Jr. | 206/315.8 |

*Primary Examiner*—Peter Vo
*Assistant Examiner*—Khan V. Nguyen
*Attorney, Agent, or Firm*—Young & Basile

[57] ABSTRACT

A lightweight golf bag having flexible rods extending longitudinally through double stitched seams of the bag body. The rod is secured at one end in a socket located in a top member of the golf bag and secured at the other end in a socket integral with a compression spring located in a cavity of the base of the golf bag. Cuffs are formed by stitching the body material at spaced locations adjacent to the top member and base.

4 Claims, 3 Drawing Sheets

METHOD OF ASSEMBLING A GOLF BAG

This application is a Division of application Ser. No. 08/275,517, filed on Jul. 15, 1994, now U.S. Pat. No. 5,445,267.

FIELD OF THE INVENTION

This invention relates generally to a golf bag construction and a method for assembling said golf bag.

BACKGROUND OF THE INVENTION

Known golf bags presently comprise a bottom base and a top member whereby the base and top member are preferably made of a molded plastic material. A tubular wall of flexible material is attached to the top member and lower base in a manner to form a tubular container open at its top member to receive various golf clubs. To camouflage the rough edges of the upper and lower ends of the flexible material, the rough edges are folded and separate cuffs are usually aligned and then sewn or riveted to the flexible material and the top member and base of the golf bag.

Sewing and riveting the cuffs to the top member and base of the golf bag add weight and require precise alignment in order to prevent slack in the material and to provide an aesthetically pleasing finished product. The alignment requires added assembly time which adds to the manufacturing cost.

Another factor that adds weight and cost to the golf bag is the reinforcing stay rods or support shafts. Golf bags are held in tension by rigid or flexible shafts where one end of the shaft is supported to the top member and a distal end of the shaft is supported to the bottom base. Currently, most support shafts are constructed of steel material having hammered flat ends that are riveted to the top member and base. The added labor and material cost of hammering the ends and adding rivets add to the overall manufacturing cost of the golf bag. In addition, these shafts, if made of a rigid material such as carbon steel or aluminum, can bend on impact and not regain its original shape. On the other hand, if the shaft is made of a flexible material, such as wood, the shaft can splinter and break upon impact which requires replacement of the shaft. Therefore, it is preferred to have the shafts made of a material that is lightweight, flexible, durable and inexpensive to assemble.

In addition, it is preferred to have a tensioning means to secure the shafts in longitudinal positions between the top member and base that is inexpensive to manufacture, lightweight and easy to assemble.

SUMMARY OF THE INVENTION

The invention is directed to address these aforementioned problems. It is an object of the invention to provide a lightweight and durable golf bag. It is also an objection of the invention to eliminate the need of attaching separate cuffs at both ends of the golf bag to hide frayed edges, but yet provide an aesthetically pleasing bag with the appearance of said cuffs. It is an object of this invention to eliminate the added costs of the rivets. It is an object to produce a golf bag that can be quickly and inexpensively assembled, and provides a means to promote quality workmanship. It is further an object of the invention to provide a reinforcing means that is inexpensive to manufacture, easily assembled, and provides flexibility to prevent permanent distortion or breakage under stress. It is finally an object of this invention to provide a tensioning means for the reinforcing means that can be easily manufactured, and assembled, and is also inexpensive and lightweight.

The improved bag has an exterior outer surface that provides the aesthetic appeal and support of a cuff at the top member and lower base of the golf bag, but does not include the labor of aligning and riveting the cuffs as separate components onto the golf bag. The bag material is die cut and constructed so that stitching requires virtually straight edge stitches to increase the efficiency of the manufacturing process and to reduce inconsistencies from bag to bag. Around each circumference or rim of the base and the top member is an annular channel or groove that accepts ends of the bag material and its associated support ring. The material is later sewn around the rims to secure the material to the top member and base and to form the cuffs.

The bag is stitched to form tunnels within the seams of the bag wherein support shafts or rods can be inserted to provide stiffness in the bag and to retain its shape. The rods are inserted in the top member at one end and the base at the other end. The top member and the base have integral portions defining apertures for receiving each rod. Within the aperture portion of the base, a flexible plastic compression means is inserted. The compression means has a footed base at one end and an integral socket for receiving one end of a rod at its distal end. The footed base of the plastic compression means has slight ridged extensions so that when pressure is placed on the compression means, the ridges lock within the aperture portion of the base to secure the plastic compression means. As the one end of the rod is inserted into the aperture portion of the base, the spring compresses, and the rod flexes to allow insertion of the upper end of the rod into the aperture of the top member.

Other objects, advantages and applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENT

Figure 1:
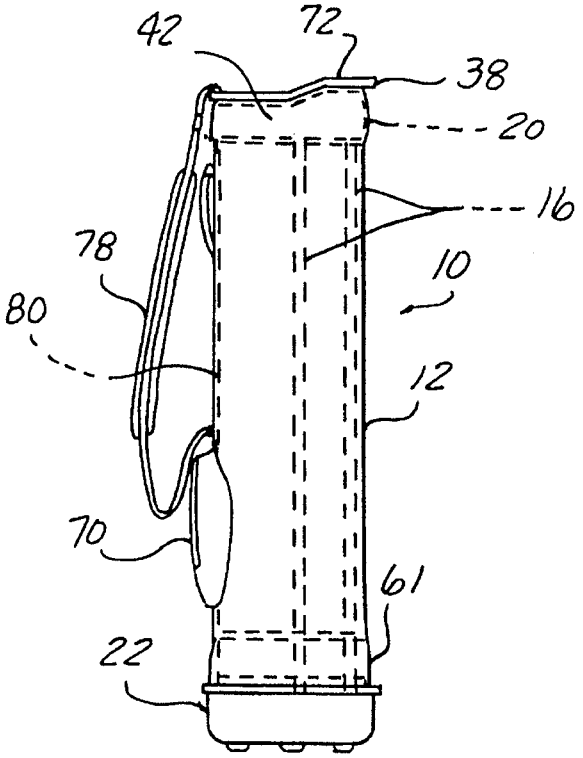
FIG. 1 is an elevation of a golf bag employing the invention.
Figure 4:
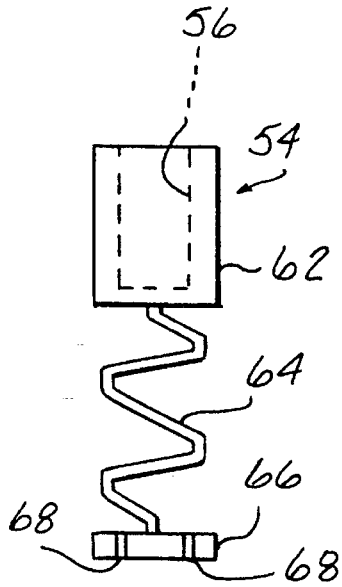
FIG. 4 is an elevation of a compression means having an integral socket and a footed base.
Figure 5:
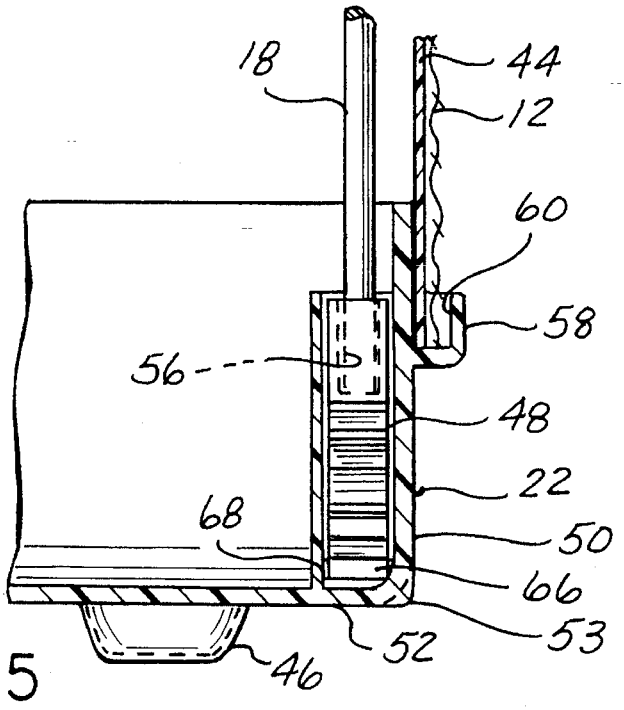
FIG. 5 is a cross-sectional area taken along line 5—5 of FIG. 3 of the base of the bag, showing the compression means installed in a cavity of the base.

Referring to FIGS. 1–7*b*, the golf bag 10 has a tubular body 12 fabricated of a lightweight material or fabric such as nylon. Two essentially rectangular pieces (11*a*, 11*b*) of nylon material are die cut to a predetermined dimension to provide a standard length and circumference for the golf bag. The die may include notches (not shown) cut into the upper and lower ends of the material as indications for seam lines and strap location. Accessory pouches and pockets 70 are also die cut and attached to rectangular pieces 11*a* or 11*b* at predetermined locations before material 11*a*, 11*b* are sewn together. At the same time, webbing 78 may be double stitched to piece 11*a* and extended to provide a carrying means. The fabric comprising the body is sewn to form a tubular body 12. As the two generally rectangular pieces of fabric are sewn together to form the tubular body 12, the seams are double stitched forming tunnels 16. The tubular body 12, thereby has two tunnels 16 running down its longitudinal axis through the two seam lines. The area between webbing 78 and rectangular piece 11*a* form a third tunnel 80. Flexible shafts or rods 18, to be discussed further, are threaded through tunnels 16 and 80 to provide the necessary rigidity to prevent the bag 10 from collapsing.

Figure 2:
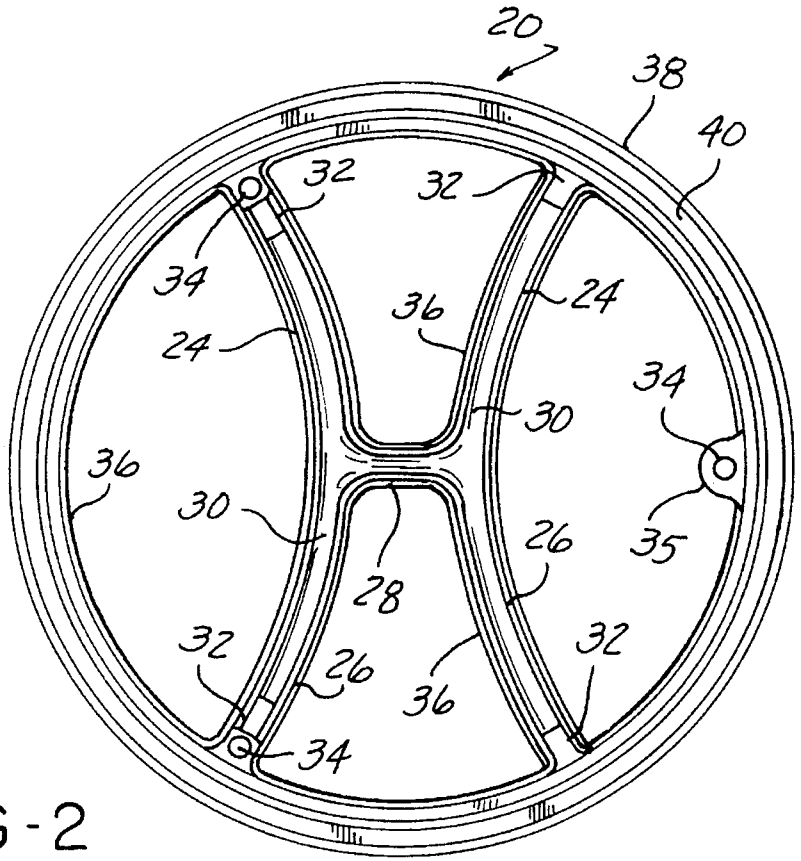
FIG. 2 is a bottom plan view of a top member of the preferred embodiment.
Figure 3:
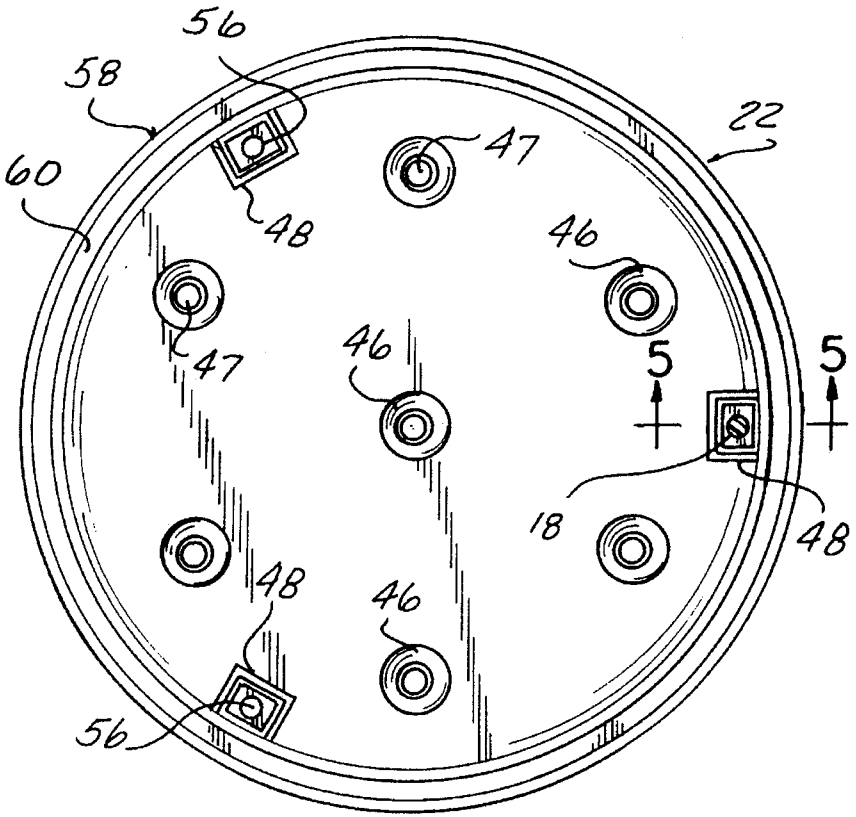
FIG. 3 is a top plan view of a base of the preferred embodiment.

A top member 20 (see FIG. 1 and FIG. 6) is attached at a top end of the tubular body 12; and a base 22 is attached at a distal end of the tubular body 12 to form support members for said tubular body. Both the top member 20 and base 22 are fabricated of a molded plastic material. The top member 20 forms a ring-shaped cylindrical body providing an opening to the tubular body 12. The top member 20 has a divider means 24 intersecting the ring. The divider means 24 separate the clubs into segregated groupings which are determined by individual preference. As seen in FIG. 2, the divider means 24 of the top member 20 are provided by a pair of curved crossbars 26 extending across the top member 20. The crossbar 26 are relatively curved in their centers and spaced from each other. A center rib 28 connects the crossbars 26 at their curved centers. The divider means 24 are approximately ½ inch deep and have hollow interiors 30, which face the interior of the bag 10 when the bag is assembled. At the ends of each crossbar 26 and proximate to the perimeter of the top member 20 is a solid portion 32 to provide rigidity and strength to the crossbars 26. Interposed between the perimeter of the top member 20 and the solid portions 32 of one of the crossbars 26 are portions defining sockets 34. At a position along the inside perimeter opposing the other crossbar, and spaced from the center rib 28 is a molded projection 35 defining a third socket 34. The sockets 34 are sized for receiving ends of the flexible rods 18. By this configuration, the position of the three rods 18 are essentially situated at approximately 120° intervals about the perimeter of the top member 20.

A protective liner 36 comprising a thin sheet of polyvinyl chloride (PVC) and a sheet of felt may be inserted around the interior perimeter of the plastic molded top member 20. The protective liner 36 is precut and pre-shaped to the perimeter of the top member 20, and inserted so that precut and pre-shaped portions also cover the crossbars 26. The protective liner 36 protects graphite shafted golf clubs from the crossbars and the interior side of the top member 20.

Extending slightly beyond the perimeter of the top member 20 is an annular rim 38 that forms a narrow channel 40 for fitting the nylon fabric and a foam support 39. A sheet of thin foam is attached, preferably stapled onto a piece of PVC or thick paper material. The resultant foam support 39 is precut and shaped to fit around the outside perimeter and fit into the annular channel 40 of the top member 20. The foam support 39 facilitates management of the nylon material when inserting the material into the annular channel 40 and holding said material to the top member 20. Once stitched in place, the combination of the nylon material, foam support 39 and top member 20 serves to form the appearance of the cuff 42 for the golf bag 10.

The base 22 of the golf bag 10 is a rigid molded plastic cup-shaped form. In the preferred embodiment, the base has a plurality of circular legs 46 extending beyond the base 22 upon which the golf bag is positioned upright. The circular legs 46 may have small concentric holes 47 for possible water drainage. Positioned within the interior of the base 22 and along the perimeter of the base 22 are three portions defining cavities 48 aligned to correspond with the three sockets 34 in the top member 12 to receive the bottom ends of the flexible rods 18. The cavity portions 48 are tapered elongated tubes extending approximately ¾ the vertical depth of the base 22. The vertical sides 50 of the base curve to form the horizontal bottom 52 of the base. Each cavity 48 tapers at the bottom of the base 22 so that the area at the bottom of the cavity 48 is slightly less than the area along the length of the cavity tube. Cavity 48 is shaped to receive a footed compression means 54 having an integral socket 56. At the location of the cavity portions 48, the vertical sides 50 form right-angle corners 53 at the horizontal bottom 52 for purposes described later.

The base 22 also has an annular rim 58 extending slightly beyond the perimeter of the base 22 and forming a channel 60. The channel 60 holds a similar foam support 44 as the top member. A thin sheet of foam is attached to a PVC or thick paper material and is precut and preformed to fit within the channel 60 and extend upwardly a few inches above the base 22. The foam support 44 facilitates the management of the nylon material for insertion into the channel 60 and attachment to base 22. When the bottom portion of the material of the bag is attached to the base 22, the foam support 44 also provides the padded appearance of a cuff 61. In addition, foam support 44 provides added strength at the lower end of the golf bag 10.

The compression means 54 is formed with integral sockets 56 and made of a molded plastic material. The upper portion of the compression means 54 has a rectangular box-like body 62 and a socket 56 formed therein, exposed for receiving the flexible rod 18. An integral accordion-shaped compression spring 64 having approximately a ⅜ inch spring stroke and molded from the same plastic material extends from the box-like body 62. At the distal end from the box-like body 62 is a footed base 66. The footed base 66 has a pair of slight ridges 68 extending from opposing sides of the footed base 66. These slight extending ridges 68 are a locking means to secure the compression means into the cavity 48 of the base 22. The plastic material of the compression means has the advantage of being lightweight and inexpensive in comparison to metal springs.

The flexible rods 18 provide the reinforcing stays for the golf bag to keep the golf bag 10 in an upright erect position. The flexible rods 18 are preferably made of fiberglass material. The fiberglass material has an advantage over previous material used for the rods such as wood and aluminum or steel. The wood rods do not have sufficient flexibility and strength, wherein they had a tendency of cracking and breaking. Steel rods add more weight. In addition, aluminum and steel can easily bend and misshapen the golf bag 10.

The Assembly

Two pieces 11*a*, 11*b* of flexible nylon material comprising the body 12 of the golf bag are die cut to a predetermined length and to conform to the contours of the top member 20 and base 22. Only straight stitch lines are required to sew the pieces 11*a*, 11*b* together. The accessories to be added to the golf bag, such as ball and umbrella retainer pouches and pockets 70 are die cut and their locations are stamped with a chalk indicator on the nylon material 11*a*, 11*b*. The accessories 70 are later sewn to the appropriate nylon piece 11*a* before the two nylon pieces 11*a*, 11*b* are seamed together. This facilitates the assembly process. A webbing 78 is attached along the longitudinal length of the nylon piece 11*a*; and then extended outwardly from the bag to provide a carrying means. A tunnel 80 is formed between the webbing 78 and the material 11*a* by the double stitching attachments to material 11*a*. Accessory bags and pouches 70 are now attached along any pre-marked locations on the body 12. Welting also may be added along the perimeter of the accessory bag 70 before stitching to said body 12. The two pieces 11*a*, 11*b* of nylon material are seamed with double stitching to form tunnels 16 along the longitudinal length of the body 12. When the two pieces of material 11*a* and 11*b* are stitched together the tubular body 12 of the bag is formed.

The top member 20 is preassembled and the protective liner 36 is inserted in the interior of the top member 20 and over the crossbars 26 and center rib 28 on the top member to provide an aesthetic and protective upper portion of the golf bag 10.

The base 22 is likewise preassembled. The compression means 54 is inserted into each of the cavities 48 of the base 22. The compression means 54 are inserted so that the footed base 66 is at the lower end of the base 22 and the integral socket 56 is exposed for receiving the flexible rod 18. Initially, the compression means 54 are loosely laying within the cavities 48 and are secured within the cavity portions 48 by a tool (not shown) that locks the footed base 66 into the tapered lower end of cavity 48.

Figure 6:
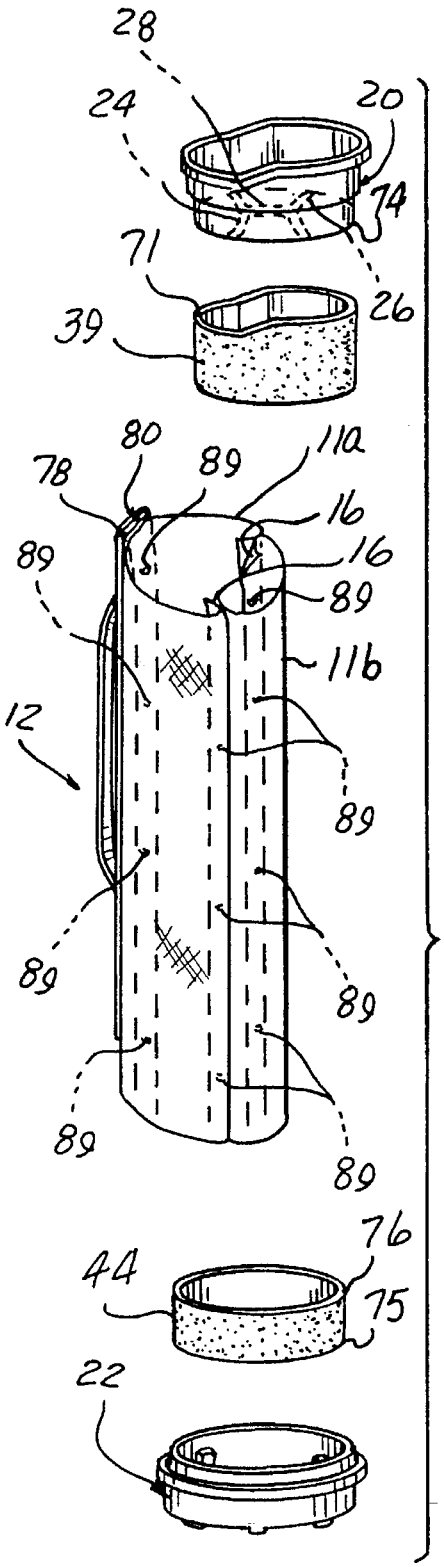
FIG. 6 is an exploded view of components comprising the assembled golf bag.

An integral pocket 82 (FIG. 7*b*) may replace material piece 11*b* (FIG. 6). The integral pocket 82 is also die cut (FIG. 7*a*) having a center piece 84 and two gussets 86 having integral tabs 88 attached thereon. The tabs 88 are sewn to the longitudinal ends of material piece 11*a* to form tunnels 16.

The bottom end of the bag material is aligned to a bottom edge 75 of foam support 44. Together, the material and foam support 44 are inserted in the annular channel 60 of the base 22. Correct alignment is required so that tunnels 16 and 80 align with cavities 48. The corner edge indicator 53 in the base 22 facilitate matching the tunnels 16, 80 to the cavities 48. The annular rim 58 of the base that forms channel 60 acts as a guide for stitching the nylon material through the plastic base 22 and foam support 44. The upper end 76 of the foam support 44 acts as a second guide for a second stitching of the material to the foam support 44. These stitches secure the nylon material to the base 22 and support 44, and also provide the aesthetic appearance of a bottom cuff 61 without the added expense of separate material and labor time.

Similarly, the upper portion of the bag material is aligned with the tope edge 71 of foam support 39. Together, the top edge 71 of the material and the foam support 39 are inserted into the channel 40. Correct alignment is required so that the double stitch tunnels 16 correspond to the upper sockets 34 formed in the crossbars 26 of the top member 20 and to two of the integral sockets 56 of the compression means 54 installed in the cavities 48 of the base 22. Tunnel 80 corresponds to socket 34 in the molded projections 35. The annular rim 38 that forms groove 40, provides a means for camouflaging any ragged edges of the cut nylon material. The contour 72 of the rim edge is a guide for sewing the material onto and through the foam support 39, the plastic top member 20, and the protective liner 36. The lower end of the top member provides a second guide 74 for seaming or stitching the nylon bag material to the top member 20. These dual seams secure the bag material to the top member, and in addition, provides the appearance of a cuff 42 without the added material and labor time to align and attach a separate cuff.

Once the tubular body 12 is attached to the top member 20 and base 22, tunnels 16 and 80 are inaccessible. Therefore, slits 89 are provided near the top member and base of each tunnel 16, 80. Each fiberglass rod 18 is inserted throughout slits 89, into a tunnel 16 or 80, and into the socket 56 of the compression means 54 located in the cavities 48 of the base 22. The two rods 18 that are adjacent to the seams of the bag are threaded through the tunnels 16 of the dual seams and inserted into the socket 34 of the top member located on either end of one of the crossbars 26. The third rod 18 is threaded through the tunnel 80 formed by the webbing 78 and the body material 11*a*. The top end of the third rod 18 is inserted into socket 34 located in projection 35. As each flexible rod 18 is inserted into a top member socket 34, the rod 18 slightly bows outwardly and depresses the compression spring 64 in the base 22, whereby the force of the rod compresses spring 64. The tunnels 16, 80 for the flexible rod are approximately an inch wide to provide room for the bowing of the rod 18. The flexible rod 18 is now locked in place and provides a constant tension on the compression spring 64 so that the flexible rod cannot easily be removed from its appropriate sockets. This procedure is repeated for all three fiberglass rods 18.

An important feature of the assembly method of the golf bag in combination with the unique compression spring is that riveting is eliminating. The prior art required folding the raw edges of the top and bottom of the tubular body 12 and then securing separate cuffs to the plastic top with rivets. In addition, the prior art secured the support rods to the cuffs with rivets. This procedure incurred an added material cost as well as an added assembly cost.

Additionally, the assembly method of the current invention maintains the golf bag dimension to its specification height. The predetermined die cut length is not altered in the assembly process. The raw ends are sewn within the channels 40, 60 of the top member 20 and base 22 respectively without alterations.

Assembly is simplified in that only straight line stitching is generally required. Accessories are pre-die cut and stitched to flat material pieces, before construction of the tubular body 12. Support rods 18 are quickly installed into tunnels and secured to compression means 54 to facilitate the assembly process.

Figure 7A:
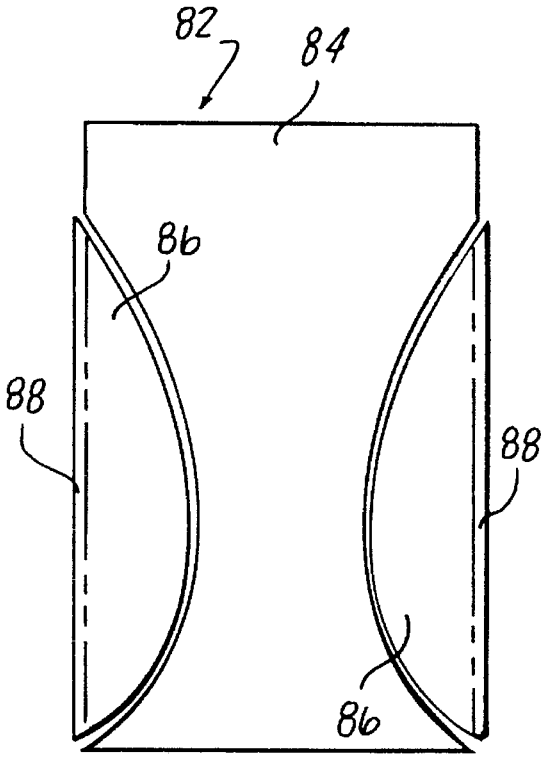
FIG. 7*a* is an exploded view of an integral pocket forming an alternative side of the golf bag.
Figure 7B:
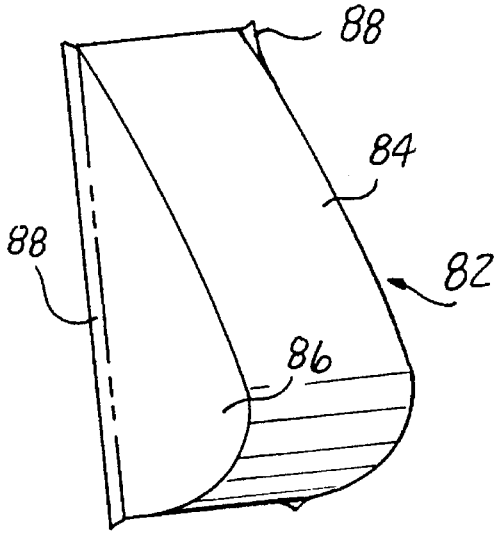
FIG. 7*b* is a perspective view of the assembled integral pocket.

The modular assembly of the golf bag also provides a marketing advantage. The golf bag construction can be easily adapted to various styles. Accessories can be easily inventoried and controlled. Pre-built pockets such as seen in FIG. 7*b* can be attached as needed.

In summary, this invention provides a lightweight, modular golf bag that is easy to manufacture and assemble. The golf bag is economical to produce by eliminating unnecessary material and labor costs, but yet provides a durable and aesthetic product.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. A method of assembling a golf bag having a top member and base:

die cutting two pieces of flexible material into generally rectangular shapes;

double stitching the rectangular pieces of material to form a tubular body wherein the double stitch forms tunnels;

inserting and locking tensioning means in the base;

aligning a lower end portion of the tubular body to a pre-cut foam support;

attaching the pre-cut foam support and lower end of the tubular body to the base;

aligning an upper end portion of the tubular body to a second pre-cut foam support;

attaching the second foam support and upper portion of the tubular body to the top member;

threading flexible rods through the tunnels; and securing the flexible rods in the top member at one end and in the tensioning means at the other end.

2. The method of assembling a golf bag of claim 1 wherein attaching foam support and lower end of the tubular body to the base comprises the steps of:

inserting the foam support and lower end of tubular body in a channel formed by a rim extending from the perimeter of the base; and stitching the second foam support and lower end of tubular body to base at a bottom edge and a top edge of the foam support to form a bottom cuff.

3. The method of assembly a golf bag of claim 1 wherein a second foam support and upper portion of the tubular body to the top member comprises the steps of:

inserting the second foam support and upper portion of tubular body in a channel formed by a rim extending from the perimeter of the top member; and stitching the second foam support and upper portion of tubular body to the top member at a top edge and a bottom edge of the top member to form a top cuff.

4. The method of assembling a golf bag of claim 1 further including the step of:

providing a third tunnel for threading a flexible rod from the top member to the base by double stitching webbing along one side of the bag, thereby providing said third tunnel between the webbing and bag.

* * * * *